United States Patent [19]

Vecchiarelli

[11] Patent Number: 4,484,612

[45] Date of Patent: Nov. 27, 1984

[54] TILTING ROLL AND TILTING ROLL ASSEMBLY FOR THE LADDER MEANS OF A VENETIAN BLIND

[75] Inventor: Francis Vecchiarelli, River Edge, N.J.

[73] Assignee: Hunter Douglas International N.V., Willemstad, Netherlands Antilles

[21] Appl. No.: 509,590

[22] Filed: Jun. 30, 1983

Related U.S. Application Data

[63] Continuation of Ser. No. 320,431, Nov. 12, 1981, abandoned, which is a continuation of Ser. No. 043,797, May 30, 1979, abandoned.

[51] Int. Cl.[3] ..... E06B 9/307; E06B 9/38

[52] U.S. Cl. ..... 160/177

[58] Field of Search ..... 160/175–178

[56] References Cited

U.S. PATENT DOCUMENTS

| | | | |
|---|---|---|---|
| 2,449,583 | 9/1948 | Burns | 160/173 |
| 2,589,846 | 3/1952 | Nelson | 160/177 |
| 3,425,479 | 2/1969 | Lorentzen | 160/176 R |

FOREIGN PATENT DOCUMENTS

| | | | |
|---|---|---|---|
| 274198 | 9/1966 | Australia | 160/177 |
| 2805469 | 8/1978 | Fed. Rep. of Germany | 160/177 |

*Primary Examiner*—Peter M. Caun
*Assistant Examiner*—Cherney S. Lieberman
*Attorney, Agent, or Firm*—Pennie & Edmonds

[57] ABSTRACT

A tilting roll and tilting roll assembly for the ladder means of a venetian blind for the ladder cord or tape of a venetian blind in which the roll which is rotatable within a base about the longitudinal axis of the roll includes a first pair of opening portions which are circumferentially spaced from one another, one cord or tape of the ladder passing over the top of the roll into engagement with one of the opening portions and the other tape or cord passing over the top of the roll from the other side and engaging the other opening portion. A second pair of opening portions is provided axially spaced from the first to enable the ladder tape or cord to be mounted on the opposite side of a lift cord.

2 Claims, 6 Drawing Figures

12
14
10
24
18
16
20
22
23
11
18

33
32
31
28
34
30

10
14
31
30
11
25
31
30

31
23
24
26
30
22
11
41
25
20
16
42
38
31
40
30

54
50
53
52
52
54
31
53
30
11

31
60
30

TILTING ROLL AND TILTING ROLL ASSEMBLY FOR THE LADDER MEANS OF A VENETIAN BLIND

This application is a continuation of my co-pending application Ser. No. 320,431, filed Nov. 12, 1981, now abandoned which, in turn is a continuation of my application Ser. No. 043,797, filed May 30, 1979, now abandoned.

BACKGROUND OF THE INVENTION

The present invention relates to a tilting roll and tilting roll assembly for the ladder means of a venetian blind.

Venetian blinds may include a member of slats supported on ladder means, in the form of a ladder tape or ladder cord where the ladder cord comprises a pair of side cords joined by cross-rings, and this is supported on a tilting roll. Pivoting of the tilting roll about its axis causes the lowering of one side of the ladder cord or tape and raising of the other side, and thus causes tilting of the rungs of the ladder means and therefore tilting of the slats. A bottom rail of the blind can be raised by means of a lift cord which usually enters the headrail at a location close to the ladder cords.

It is often found that the slats can move endwise relative to one another, for example, if they are contacted by a person or caught by a draught and this makes the blind look unsightly. The construction of the invention enables this difficulty amongst others to be overcome in a simple and inexpensive manner with a small number of parts.

SUMMARY OF THE INVENTION

It is now proposed, according to the present invention, to provide a tilting roll comprising, in combination:

(a) a hollow roll tiltable abouts its longitudinal axis;
(b) means defining a first pair of side cord engaging opening portions circumferentially spaced from one another on said roll; and
(c) means defining a second pair of side cord engaging opening portions circumferentially spaced from one another on said roll and which are axially spaced from the first pair.

The tilting roll, in use, may be mounted on a tilting rod or a base which, when provided, has a passage for the lift cord and passages for the side cords. Thus, the invention further provides a tilting roll assembly for the ladder means of the type having a pair of side cords joined by cross-rungs of a venetian blind, said assembly comprising, in combination;

(a) a base for mounting within a venetian blind headrail;
(b) a first passage within said base for the lift means of the venetian blind;
(c) a hollow roll tiltable within said base about its longitudinal axis;
(d) means defining a first pair of side cord engaging opening portions circumferentially spaced from one another on said roll;
(e) means defining a second pair of side cord engaging opening portions circumferentially spaced from one another on said roll and which are axially spaced from the first pair; and
(f) second and third passages through said base for the side cords of said venetian blind, said second and third passages being located one on each axial side of the first passage.

By providing two pairs of opening portions, which are axially spaced from one another, the same roll can be used at each end of the blind and the lift cords of the blind can be arranged axially inwardly of the side cords at each end. This has the advantage that it tends to reduce the possibility of the slats moving lengthwise relative to one another, especially in the position of the blind when the lift means are not fully tensioned, e.g. in the fully lowered position.

The passages for the lift means and side cords may be in the form of apertures or open-sided recesses in the bottom of the base or indeed the bottom of the base may be made sufficiently narrow for the cords to pass on either side thereof.

According to another aspect of the invention, there is provided a venetian blind comprising:

(a) a headrail;
(b) a base mounted within said headrail;
(c) a hollow roll tiltable within said base about the longitudinal axis of the roll;
(d) a passage through said headrail and base;
(e) a lift cord extending through said passage;
(f) means defining a first pair of engaging opening portions circumferentially spaced from one another on said roll, and positioned on one axial side of the lift cord;
(g) means defining a second pair of side cord engaging opening portions circumferentially spaced from one another on said roll which are axially spaced from the first pair and on the other axial side of the lift cord; and
(h) one side cord of a pair extending on one side of the roll, over the top of the roll and into that one of the opening portions on the opposite side of a vertical plane including the axis of rotation of the roll and the other side cord of the pair passing on the other side of the roll and extending over the top of the roll and engaged in the opening portion of the first pair on the other side of said vertical plane.

With the construction of tilting roll according to the invention it is equally possible, when desired, to mount the side cords axially inwardly of the lift means to prevent relative displacement of the slats.

The opening portions can take a number of different forms. They can, for example, be disposed such that the opening portions of the first pair are in a first plane perpendicular to the axis and the opening portions of the second pair are in another plane perpendicular to the axis and spaced from the first plane. Such opening portions could, thus, be in the form of four apertures in the roll.

In another arrangement, one opening portion of the first pair and one opening portion of the second pair are joined to one another by a first further opening to form a single opening on one side only of the longitudinal axis and the other opening portion of the first pair and the other opening portion of the second pair are joined to one another by a second further opening to form a single opening on the other side of the longitudinal axis.

This arrangement can, for example, be such that the single openings are each in the form of a symmetrical Y, the plane of symmetry being perpendicular to the axis of rotation of the roll, the stems of the Y being wider than the arms and being directed away from one another in a circumferential direction over the top of the roll. By having the stems of the Y wider than the arms, a knot or retaining member on the end of the cords of the ladder means can be passed through this wider portion and can then engage in the arms, allowing the cords to pass over the top of the roll.

In another arrangement, the single openings are each in the form of an asymmetric Y, having a long arm and a short arm, the long arm of one opening extending towards one axial side, the long arm of the other opening towards the other axial side, the stems of the Y each being in a plane perpendicular to the axis and being, once again, wider than the arms and directed away from one another in a circumferential direction over the top of the roll. With such an arrangement, the two cords of a ladder means can be arranged in slightly axially spaced relation so that they do not overlie one another.

A tongue may be provided on the tilting roll which is adapted to clamp the side cable of the ladder means passing over the roll.

In order that the invention may more readily be understood, the following description is given, merely by way of example, reference being made to the accompanying drawings.

BRIEF DESCRIPTION OF THE PREFERRED EMBODIMENTS

Figure 1:
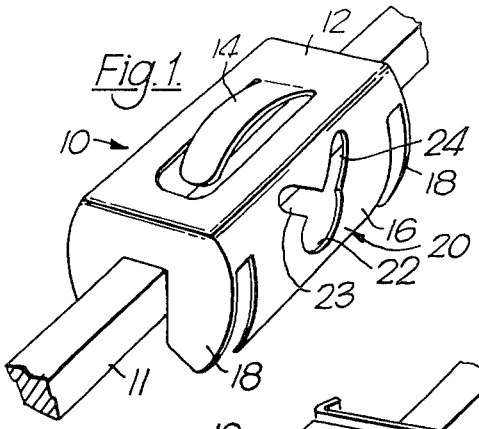
FIG. 1 is a perspective view of a presently preferred embodiment of a tilting roll according to the invention.

The tilting roll 10 shown in FIG. 1 is illustrated mounted on a tilting rod 11 which can be rotated by any conventional tilting mechanism (not shown). The tilting roll 10 includes a top surface 12 having formed therein a tongue 14, and two mirror image side portions 16, only one of which can be seen in FIG. 1. There are also two end portions 18 provided with a square cut-out to receive the square section tilting rod 11.

Formed in each of the side portions 16 is an opening 20, this opening 20 is identical with an opening on the other side portion and is at the same axial location. It will be noted that the opening 20 is in the form of a symmetrical Y having a stem portion 22 which is wider than either of the equally angled side arms 23 and 24. The opening in the other side portion 16 (not shown) is identical and is disposed in the same vertical plane perpendicular to the axis of rotation about the tilting rod 11.

Figure 3:
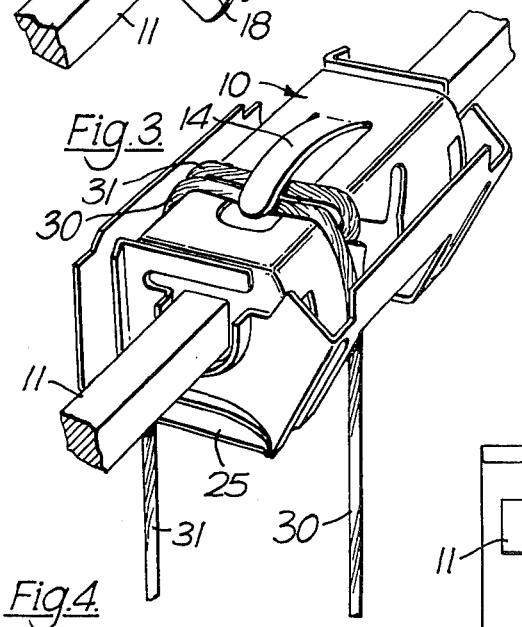
FIG. 3 is a perspective view of a tilting roll assembly according to the invention.

As can be seen in FIG. 3, the tilting roll 10 is mounted on a base 25 which in turn can be mounted in the head rail 26 (FIG. 6) of a Venetian blind.

Figure 2:
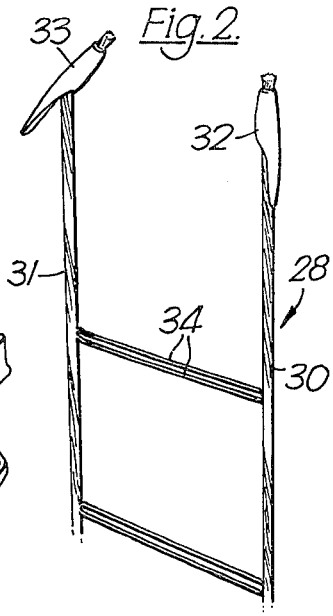
FIG. 2 is a perspective view of the upper end portion of a Venetian blind ladder cord means having a pair of side cord intended to cooperate with the roll of FIG. 1.

FIG. 2 illustrates a ladder means in the form of a side cord including two upright cords 30 and 31 provided with end tags 32 and 33, the cords 30 and 31 being provided with double rungs 34 for the insertion of the slats of a Venetian blind and where each of the cords 30, 31 comprise a ladder side means.

Referring again to FIG. 3, it will be seen that the cord 30 is passed over the top of the roll, from the right to the left, and the cord 31 is passed over the to of the roll from the left to the right. In each instance the tag is passed through the opening 20, this being facilitated by the wider stem portion 22 of the opening. It will be seen that each of the cords 30 and 31 is passed under and clamped by the tongue 14 on the top of the roll to retain the cord in place.

Figure 6:
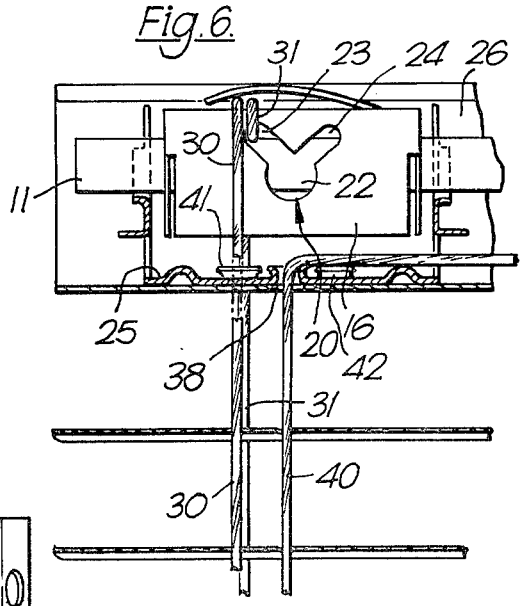
FIG. 6 is a side elevation, on a reduced scale, showing the assembly of FIG. 2 in position in a venetian blind headrail.

If reference is now made to FIG. 6, which illustrates the lefthand end of a venetian blind, it will be seen that cord 30, and also the cord 31 is in the arm of the opening which is nearer to the lefthand side of the roll. The base 25 is located in the headrail 26 at a position such that an opening 38 through the headrail and base is positioned approximately under the stem 22 of the opening 20. Since the cords 30 and 31 are both in the arm which is to the left, they are both to the left of a lift cord 40 which passes through the opening 38. The cord 31 passes through an opening 41 in the base 25 and the cord 30 through another opening which cannot be seen because it is in front of the section. Thus, the lift cord is located to the right or axially inwardly of the ladder side cord.

A similar situation exists at the righthand side of the blind; but in this instance the ladder side cords are located in the righthand arms of the openings, so that they are to the right of the lift cord and thus again axially outwardly, and pass through openings corresponding to openings 42 and the other opening mentioned which cannot be seen. It will be appreciated, therefore, that identical rolls can be used at each end of the blind and there is no need to select one roll as against another. Furthermore, because the cords pass over the top of the roll and are engaged in openings on the far side of the roll, the roll can be rotated more than 90° before there is any tendency for a cord, which is up until then being lowered, to rise.

Figure 4:
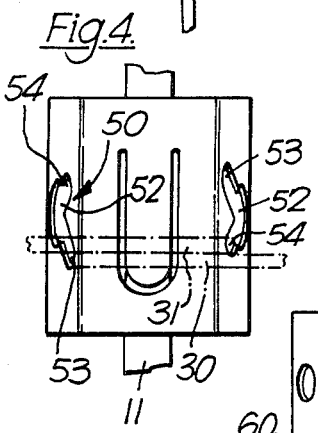
FIG. 4 and FIG. 5 are plan views of a modified form of the roll.

FIG. 4 illustrates a modified version in which the apertures are indicated by the reference numeral 50 and include a wider stem portion, as before, but the arms 53 are longer than the arms 54, one arm 53 extending towards one axial end the other longer arm 53 towards the other axial end. In this arrangement, the cord 30 can be accommodated in the longer arm 53 and the cord 31 in the shorter arm 54 so that the cords can run parallel on the top of the roll with respect to one another. The arms 53 and 54 which are not shown filled with cords are used at the other end of the blind.

Figure 5:
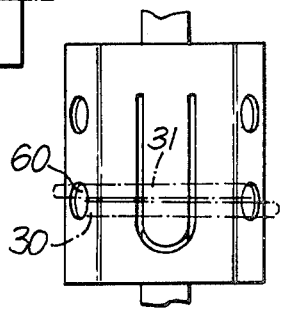

A simpler form is illustrated in FIG. 5, in which there are four identical holes 60, these holes being arranged in two pairs, the two pairs being axially spaced from one another, and the holes of a pair being circumferentially spaced from one another. The positioning of the cords 30 and 31 is illustrated from which it will be seen that the holes 60 are preferably of considerably larger diameter than the cords, to also allow the parallel arrangement of the cords.

The tape roll can be of the known type, being provided with bearings, for bearing directly in the base, or of the type in which the tape roll is journalled solely by the tilt rod (as shown).

I claim:

1. A tilting roll for cord type ladder means of a venetian blind where the ladder means comprises a pair of side cords joined by cross rungs, said tilting roll comprising:

(a) a hollow roll tiltable about its longitudinal axis;

(b) means defining a first pair of side cords engaging opening portions circumferentially spaced from one another on said roll with each opening portion adapted to receive a cord of a first pair of side cords extending circumferentially side by side over a portion of the roll to prevent axial movement of the side cords with respect to the roll and where the first pair of side cords is adapted to support a first end of the blind, said first pair of opening portions being in a first plane perpendicular to said axis;

(c) means defining a second pair of side cords engaging opening portions circumferentially spaced from one another on said roll and which are axially spaced from the first pair of side cords engaging portions adapted to alternatively receive a second pair of side cords extending circumferentially side by side over a portion of the roll to prevent axial movement of the cords with respect to the roll and were the second pair of ladder cords is adapted to support a second end of the blind, said second pair of opening portions being in a second plane perpendicular to said axis and spaced longitudinally with respect to said first plane wherein one opening portion of the first pair of side cords engaging opening portions and one opening portion of the second pair of side cords engaging opening portions are joined to one another to form a single opening on one side of the longitudinal axis of the roll and the other opening portion of the first pair of side cords engaging opening portions and the other opening portion of the second pair of side cords engaging opening portions are joined to one another to form a single opening on the other side only of the longitudinal axis of the roll and where the single openings are each in the form of an asymmetrical Y, having a long arm and a short arm, the long arm of one opening extending towards one axial end of the roll, and the long arm of the other opening extending towards the other axial end of the roll, the stems of the Y's of the single openings being in one plane perpendicular to the axis of rotation of the roll and being wider than the arms and with the free ends of the arms of one single opening being directed towards the free ends of the arms of the other single opening circumferentially of the roll.

2. A tilting roll for cord type ladder means of a venetian blind where the ladder means comprises a pair of side cords joined by cross rungs, said tilting roll comprising, in combination:

(a) a hollow roll tiltable about its longitudinal axis;

(b) means defining a first pair of side cords engaging opening portions circumferentially spaced from one another on said roll with each opening portion adapted to receive a cord of a first pair of side cords extending circumferentially side by side over a portion of the roll to prevent axial movement of the cords with respect to the roll and where the first pair of side cords is adapted to support a first end of the blind, said first pair of opening portions being in a first plane perpendicular to said axis;

(c) means defining a second pair of side cords engaging opening portions circumferentially spaced from one another on said roll and which are axially spaced from the fist pair of side cords engaging portions adapted to alternatively receive a second pair of side cords extending circumferentially side by side over a portion of the roll to prevent axial movement of the cords with respect to the roll and where the second pair side cords is adapted to support a second end of the blind, said second pair of opening portions being in a second plane perpendicular to said axis and spaced longitudinally with respect to said first plane wherein one opening portion of the first pair of side cords engaging opening portions and one opening portion of the second pair of side cords engaging opening portions are joined to one another to form a single opening on one side only of the longitudinal axis of the roll and the other opening portions of the first pair of side cords engaging opening portions and the other opening portions of the second pair of side cords engaging opening portions are joined to one another to form a single opening on the other side only of the longitudinal axis of the roll, said single opening being each in the form of a symmetrical Y, the plane of symmetry being perpendicular to the axis of the rotation of the roll, the stems of the Y being wider than the arms and the free ends of the arms being directed away from one another in a circumferential direction over the top of the roll.

* * * * *